US006937198B2

(12) United States Patent
Iijima et al.

(10) Patent No.: US 6,937,198 B2
(45) Date of Patent: Aug. 30, 2005

(54) GLASS ANTENNA SYSTEM FOR VEHICLES

(75) Inventors: Hiroshi Iijima, Osaka (JP); Hitoshi Kakizawa, Osaka (JP); Ryokichi Doi, Osaka (JP)

(73) Assignee: Nippon Sheet Glass Company, Limited, Tokyo (JP)

( * ) Notice: Subject to any disclaimer, the term of this patent is extended or adjusted under 35 U.S.C. 154(b) by 0 days.

(21) Appl. No.: 10/872,622

(22) Filed: Jun. 21, 2004

(65) Prior Publication Data

US 2004/0257286 A1 Dec. 23, 2004

(30) Foreign Application Priority Data

Jun. 20, 2003 (JP) ..... 2003-175721

(51) Int. Cl.[7] ..... H01Q 1/32
(52) U.S. Cl. ..... 343/713; 343/704
(58) Field of Search ..... 343/713, 704, 343/711, 712; H01Q 1/32

(56) References Cited

U.S. PATENT DOCUMENTS 5,831,580 A * 11/1998 Taniguchi et al. ..... 343/713
6,147,654 A 11/2000 Nagy
2004/0080460 A1 * 4/2004 Davies ..... 343/713
2005/0035913 A1 * 2/2005 Baranski ..... 343/713

FOREIGN PATENT DOCUMENTS

DE 38 08 401 A 9/1989
DE 101 46 439 C 11/2002

* cited by examiner

*Primary Examiner*—Hoanganh Le
(74) *Attorney, Agent, or Firm*—RatnerPrestia

(57) ABSTRACT

A glass antenna system for vehicles to receive AM and FM bands is provided. An electrically conductive transparent film is formed on a side glass. A silver printed line have a wide width is formed around the electrically conductive transparent film. A loop-shaped silver printed line is provide surrounding the film, which is capacitively coupled to the body. In this manner, an opening is formed in a space between the silver printed line and the electrically conductive film. An electrically shorted portion is provided between the silver printed line and the electrically conductive film. A coaxial feeder for AM/FM is provided. A central conductor of the feeder is connected to the silver printed line and the outer conductor to the body.

9 Claims, 3 Drawing Sheets

GLASS ANTENNA SYSTEM FOR VEHICLES

BACKGROUND OF THE INVENTION

1. Field of the Invention

The present invention generally relates to a glass antenna system for vehicles, particularly to a glass antenna system for receiving AM and FM broadcasts.

2. Description of the Prior Art

A rod antenna has been provided as an antenna system for receiving AM and FM broadcasts. An antenna element of the rod antenna is protruded from the body of a vehicle, so that the antenna element has a tendency to be injured. As an alternative to the rod antenna, a glass antenna system has been provided in which the pattern of electrically conductive lines of the paste including silver powders (referred to as silver printed lines) are printed on a window glass of a vehicle.

In the glass antenna system using silver printed lines, an antenna pattern becomes complicated in order to realize a good sensitivity for FM band (76–90 MHz) in the case that the antenna pattern is formed on a small window such as a side window, resulting in a bad appearance of the side window.

A slot antenna has also provided which is formed in a space between an electrically conductive transparent film for reflecting sunlight provided on a glass window of a vehicle and a body of the vehicle. This kind of a slot antenna has been disclosed in Japanese Patent Publication Nos. 6-45817, 9-175166 and 2002-290145.

An antenna disclosed in Japanese Patent Publication No. 6-45817 is a slot antenna formed on a windshield of a vehicle. The technical word "slot antenna" means an antenna comprising a rectangular opening having a fixed length and width in an electrically conductive plate. The slot antenna, therefore, has both ends in a rectangular opening independently of the shape of the opening. The slot antenna disclosed in the Japanese Patent Publication is structured by a complete loop-shaped opening, so that the slot antenna does not have both ends thereof. In this meaning, this slot antenna is a slot antenna in a broad sense. This slot antenna is also has a complicated structure because an interface region is required to match the impedance of the slot antenna to that of a coaxial feeder.

The antenna disclosed in Japanese Patent Publication No. 9-175166 has a composite structure consisting of a slot antenna and an antenna element provided in the slot antenna in order to receive a wide frequency band.

A slot antenna for receiving FM and TV bands is disclosed in Japanese Patent Publication No. 2002-290145. This slot antenna is formed between an electrically conductive film and a body of a vehicle, and comprises two electrically conductive portion each for electrically connecting the electrically conductive film and the body of a vehicle to each other. In this slot antenna, the bands capable of receiving are limited to only FM and TV bands, and then AM band may not be received.

SUMMARY OF THE INVENTION

It is an object of the present invention to provide a glass antenna system for vehicles having a simple structure and capable of receiving both AM and FM bands.

A glass antenna system according to the present invention is structured in such a manner that the system functions both as a planar antenna for receiving AM band and as a slot antenna for receiving FM band. The term "slot antenna" herein means an antenna comprising an opening having a fixed length and width in an electrically conductive plate.

Also, the word "opening" is used herein to mean an opening which is formed in an electrically conductive plate by removing a part thereof. The slot antenna, therefore, has both ends in an opening independently of the shape of the opening.

According to the present invention, a loop-shaped opening is formed between an electrically conductive portion and an electrically conductive printed line surrounding the electrically conductive portion. By providing an electrically shorted portion at one position in the opening, the opening may function as a slot antenna for receiving FM band. In this case, the electrically conductive printed line is to be connected in an alternating current (AC) manner to a metal part of a vehicle according to the definition of the word "slot antenna". As the electrically conductive printed line is provided along the circumference of a window glass, the electrically conductive printed line is capacitively coupled to the metal part of a vehicle, and then is connected to the metal part of a vehicle in AC manner.

On the other hand, the electrically conductive portion and electrically conductive printed line are connected to each other by an electrically shorted portion to function as a planar antenna for receiving AM band. In this case, both the electrically conductive portion and the printed line should not be connected to the metal part of a vehicle in AC manner. As the printed line is selected so that the impedance thereof is high in AC band, the printed line is not connected to the metal part of a vehicle in AC manner.

In this manner, a glass antenna system according to the present invention may function as a planar antenna and slot antenna to allow the reception of AM and FM bands.

A glass antenna system for vehicles according to the present invention comprises: an electrically conductive portion formed on a window glass of a vehicle except for a region adjacent to a metal portion of a vehicle surrounding the window glass; a loop-shaped electrically conductive printed line formed in the region so that an opening is formed surrounding the electrically conductive portion and so as to be capacitively connected to the metal portion; an electrically shorted portion to short between the electrically conductive portion and the loop-shaped electrically conductive printed line; and a coaxial feeder, the central conductor thereof being connected to the electrically conductive portion and the outer conductor thereof being connected to the metal portion; respectively; wherein the electrically conductive portion and the loop-shaped electrically conductive printed line function as AM antenna, and the opening functions as FM antenna.

The electrically shorted portion is provided at a position where the impedance of a slot antenna formed by the opening is matched to that of the coaxial feeder.

DESCRIPTION OF THE EXEMPLARY EMBODIMENT

Figure 1:
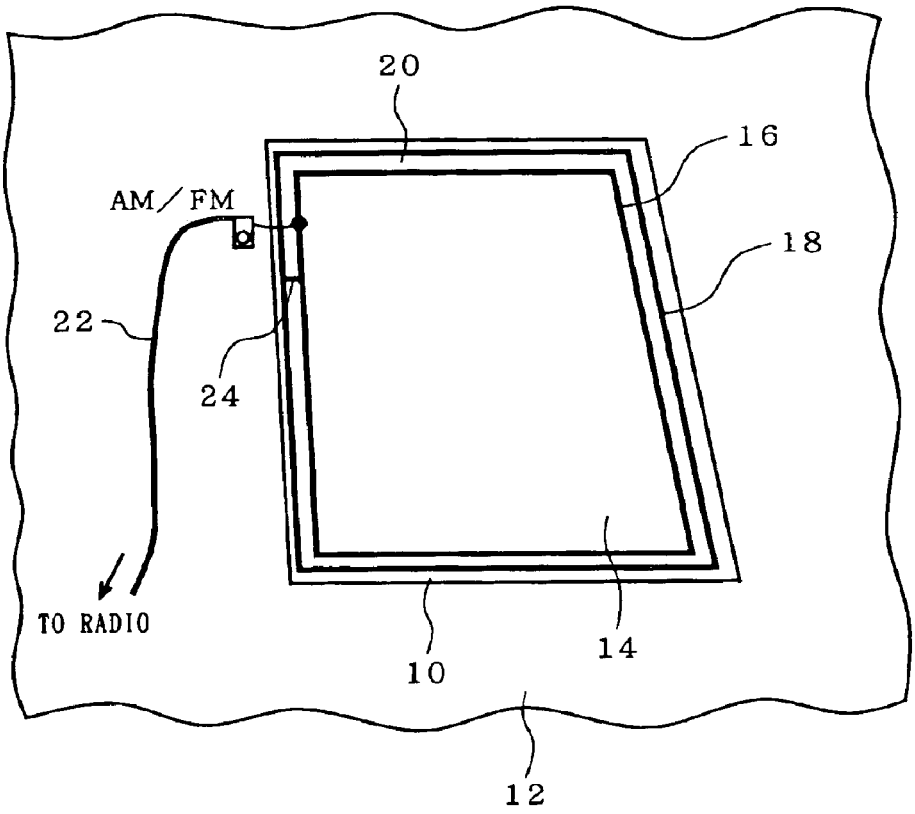
FIG. 1 shows an embodiment of a glass antenna system for vehicles according to the present invention.

Referring to FIG. 1, there is shown an embodiment of a glass antenna system for vehicles according to the present invention. The antenna system is provided on a side window of a vehicle.

A side glass 10 forming a side window is surrounded by a body 12 made of metal. An electrically conductive transparent film 14 for reflecting sunlight is provided on the side glass 10, and a silver printed line 16 having a wide width is formed on the peripheral portion of the electrically conductive transparent film 14. A loop-shaped silver printed line 18 is provide surrounding the film 14, which is capacitively coupled to the body 12. In this manner, an opening 20 is formed in a space between the silver printed line 18 and the electrically conductive film 14. An electrically shorted portion (i.e., a short stub) 24 is provided between the silver printed line 18 and the electrically conductive film 14. As a result, the silver printed line 18 and the electrically conductive film 14 are connected in a direct current (DC) manner. The purpose for providing the silver printed line 16 around the electrically conductive film 14 is to make the connection of a central conductor of a coaxial feeder thereto easy and to increase the sensitivity of a slot antenna by improving the flow of a current.

Also, the purpose for providing the loop-shaped silver printed line 18 is such that the line 18 functions together with the film 14 as a planner antenna for AM band, and the line 18 capacitively coupled to the body 12 to function the opening 20 between the film 14 and the line 18 as a slot antenna.

The electrically conductive transparent film 14 may be formed directly on the surface of the side glass 10 or may be adhered to the side glass. In the case of a laminated glass, an electrically conductive film may be stacked in the laminated glass. It is preferable that a sheet resistance of the electrically conductive transparent film 14 is low (for example, lower than 4Ω/□).

The glass antenna system shown in FIG. 1 further comprises a coaxial feeder 22 for AM/FM. A central conductor of the feeder is soldered to the silver printed line 16 and the outer conductor to the body 12.

The connections of the central and outer conductors of the coaxial feeder 22 for AM/FM may be implemented by using terminals and connectors other than soldering. In the case of a laminated glass, a film-shaped connector that is embedded in the laminated glass may be used for connecting the conductors to an electrically conductive transparent film provided in the laminated glass.

The position of a terminal of the coaxial feeder 22 for AM/FM may be determined considering a design and a fabrication thereof.

In the glass antenna system shown in FIG. 1, the electrically conductive film 14 and loop-shaped silver printed line 18 are used for AM antenna as a planar antenna, and the opening 20 electrically shorted by means of the short stub 24 is used for FM antenna as a slot antenna. As stated above, the body 12 and film 14 must be electrically shorted in order to cause the opening 20 to function as a slot antenna, and then the short stub 24 is provided for this purpose.

The position of the short stub 24 is selected in a following manner. That is, where the opening 20 forms a slot antenna for FM, the impedance of the slot antenna should be matched to that of the coaxial feeder 22 for AM/FM.

The impedance of the slot antenna is determined by the length L thereof (i.e., the length of the opening 20), the width thereof (i.e., the width of the opening 20), the resistance of the silver printed line 18, and the position of the short stub 24 with respect to the feeding point of the coaxial feeder. While the position of short stub may be expected by simulation, it would be also determined by measuring the impedance of the slot antenna.

The antenna system having a structure described above, the length L of the slot antenna is determined by following equation;

$$L=(\lambda_0/n)\times k$$

herein, $\lambda_0$ is the wavelength of the central frequency of a band to be received, n is 1, 2, 4 . . . , and k is a shortening factor of antenna size due to glass, the range thereof being 0.55–1.0. The shortening factor relates to a propagation rate of a wave propagated through a dielectric substrate (a glass plate in this case), and is a ratio of the size of an antenna formed on the dielectric substrate with respect to the size of an antenna provided in a space rather than on the dielectric substrate. Therefore, it is preferable that the length of a slot antenna is determined so that the equation denoted above is satisfied.

In the case that the glass antenna system according to the present invention is provided on a window glass having small area, the length of an opening is determined such that n=2 in the equation, i.e. the antenna resonates at ½ wavelength.

As FM band (76–90 MHz) is received by means of the slot antenna, the maximum ½ wavelength is approximately 1.95 m. Therefore, it is preferable that the length L of the slot antenna is approximately 1.5 m or less assuming k=0.65. Also, the width of the opening is determined so as to be in the range of $(0.0004\lambda_0–0.02\lambda_0)\times k$.

The distance between the loop-shaped silver printed line 18 and the body 12 is regulated such that the impedance is high for AM band and low for FM band. The capacitance between the line 18 and the body 12 is regulated in a range of 20–30 pF for AM band.

It is also desirable that each of the silver printed lines 16 and 18 has preferably the width of 5 mm or more from the point of view for the connection of a central conductor of the coaxing feeder 22 and the antenna efficiency.

In designing a slot antenna having the length and width of the opening described above, the electrically conductive transparent film 14 and the loop-shaped silver printed line 18 work as a planner antenna for receiving AM band, so that the area surrounded by the line 18 is determined in view of AM sensitivity. AM sensitivity is therefore determined by the area of a window glass. The area of a window glass of 0.14 $m^2$ or more is preferable in view of AM sensitivity.

Consequently, the area of a window glass to which a glass antenna system according to the present invention is formed may be at least 0.14 $m^2$ in the case that the antenna is resonated at ½ wavelength. As a result, a glass antenna system according to the present invention may be applied to a side window having a small area.

When a vertical dimension of the opening 20 is 400 mm and a horizontal dimension is 350 mm, as an example, the length L of the opening is 1500 mm. On the other hand, ½ wavelength is approximately 1.8 m for the central frequency 83 MHz of FM band (76–90 MHz). Considering a shortening factor, the length L of a slot antenna satisfies the equation (n=2) described above. Also, the area of a window glass is 0.14 $m^2$ and therefore satisfies the condition necessary for AM sensitivity. It will be understood that the glass antenna system having such dimensions may successfully receive both AM and FM bands. It is also understood that a glass antenna system according to the present invention may easily be implemented for a side window having an area of 0.15 $m^2$ or more, for example.

The operation will now be described in the case that the glass antenna system as shown in FIG. 1 functions as AM and FM antennas.

(1) AM Antenna

The electrically conductive transparent film 14 and the loop-shaped silver printed line 18 become a planar antenna and function as AM antenna.

(2) FM Antenna

The loop-shaped silver printed line 18 is equivalent to the body in potential because the line 18 is capacitively coupled to the body in FM band. A slot antenna, therefore, is formed between the film 14 and the line 18. A better sensitivity may be obtained because the short stub 24 is provided at the position where the impedance of the slot antenna is matched to that of the coaxial feeder 24.

In the embodiment described above, it is useful that the area of the side glass is 0.15 $m^2$ or more. The distance between the film 14 and the line 18 is regulated in a range of 10–30 mm for an impedance for FM.

Figure 2:
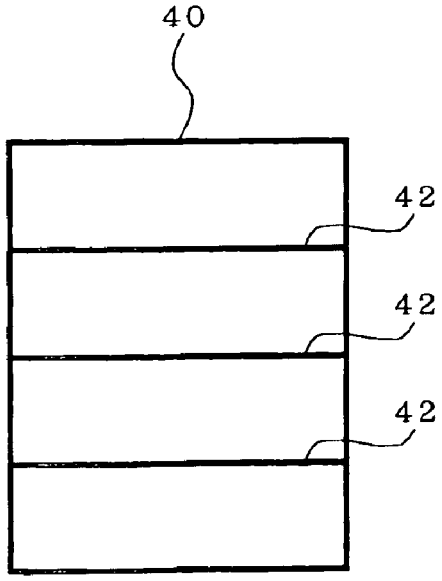
FIG. 2 shows an example of an electrically conductive pattern which is formed by means of silver printed lines on the surface of a window glass.

In the embodiment described above, the electrically conductive transparent film has been used. However, a ladder-shaped electrically conductive pattern made of silver printed lines may also be used instead of the electrically conductive film. An example of an electrically conductive pattern which is formed on the surface of a window glass by means of silver printed lines is shown in FIG. 2. The pattern comprises a rectangular silver printed line 40 at a circumferential portion and a plurality of horizontal silver printed lines 42 within the rectangular line 40. The number of the printed lines 42 may be determined considering an appearance thereof and AM sensitivity. If the number thereof is three or more, then the sensitivity equivalent to that of the electrically conductive transparent film may be obtained.

Also, the space between the body 12 and the line 18 work as a capacitor, which capacitor may be replaced by a capacitor having an equivalent capacitance as a lumped constant. In that case, one end of the replaced capacitor is connected to the film 14 and the other end is directly connected to the body 12, at the position of the short stub 24.

While the antenna system is provided on the side glass of a vehicle with the resonance wavelength being ½ wavelength in the embodiment described above, the antenna system may be applied to a windshield or rear glass if the resonant frequency is one wavelength in the equation described above.

Figure 3:
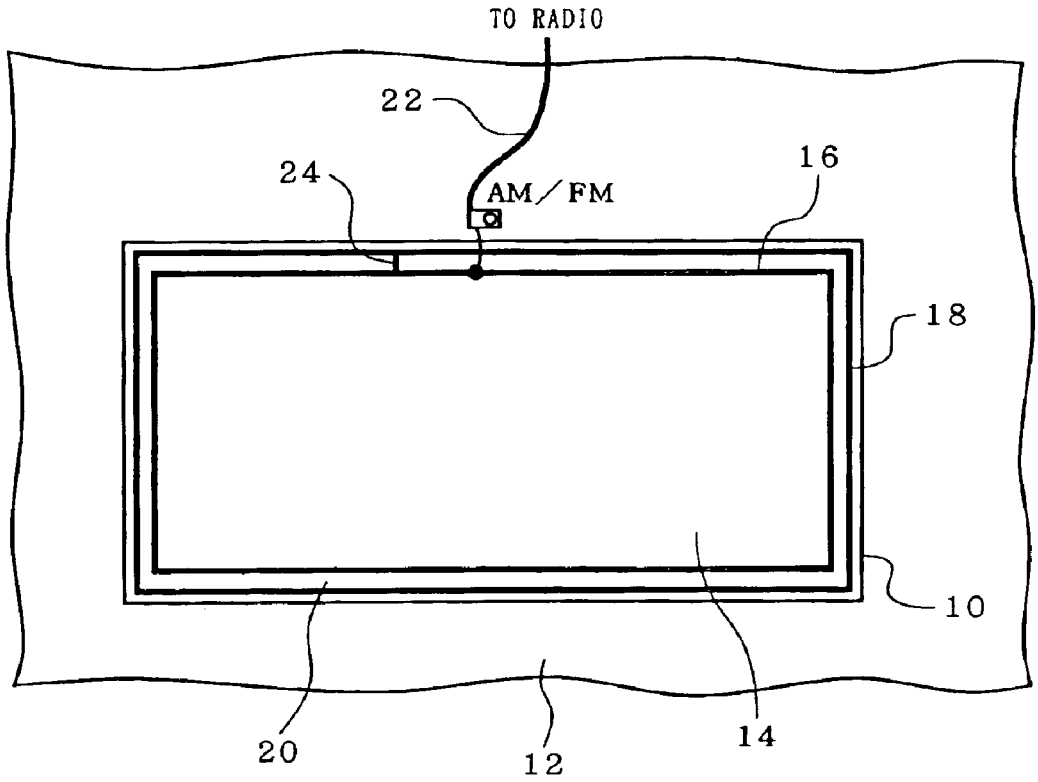
FIG. 3 shows a glass antenna system formed on a windshield.

An electrically conductive transparent film 14 may be used as shown in FIG. 3 in the case that an antenna system is provided on a windshield. The structure of the antenna system is the same as in the side glass. The same element as in FIG. 1 is designated by the same reference numeral. When FM band (76–90 MHz) is received by a slot antenna, a maximum one wavelength is approximately 3.9 m. It is understood that the antenna system may be provided on a windshield considering a shortening factor.

Figure 4:
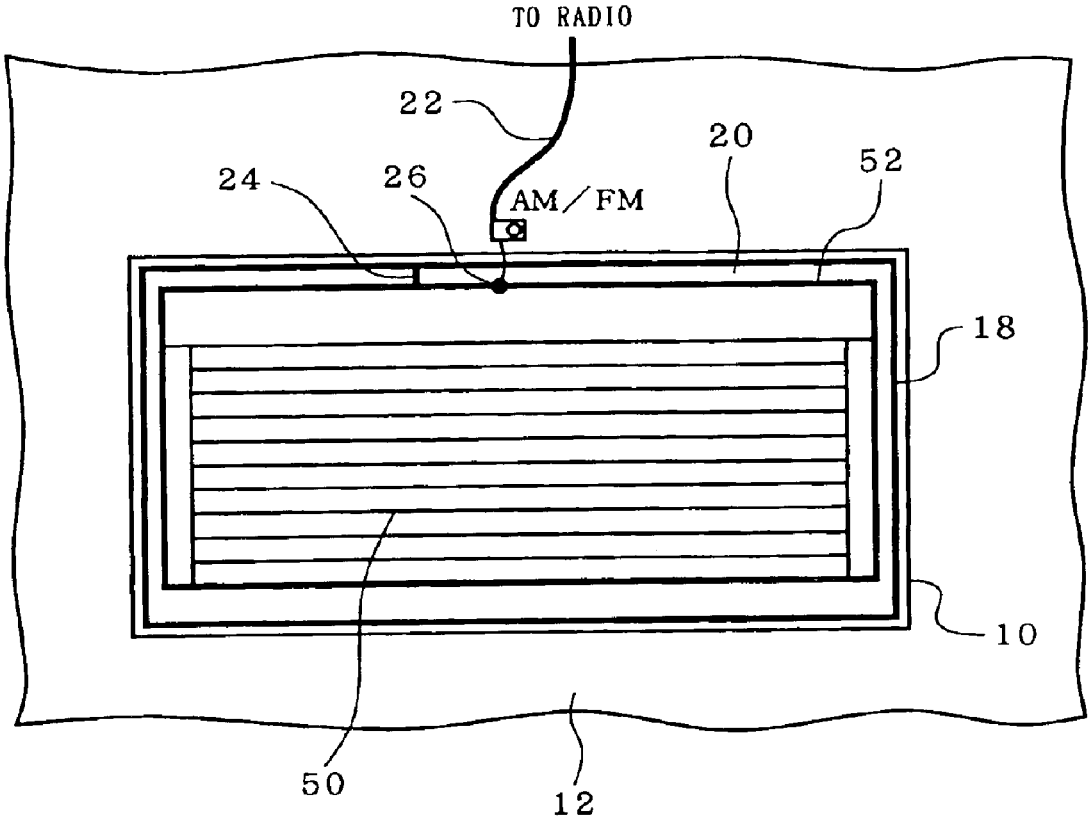
FIG. 4 shows a glass antenna system using a heating line.

A heating line or an electrically conductive transparent film may be used in the case that an antenna system is provided on a rear glass. FIG. 4 shows an example in which a heating line 50 is used. A silver printed line 52 is formed surrounding the heating line 50 and is connected to the heating line 50. A loop-shaped silver printed line 18 is formed surrounding the silver printed line 52, which is capacitively coupled to the body. In this manner, an opening 20 is formed in a space between the printed lines 52 and 18. A short stub 24 is provided between the printed lines 52 and 18. A coaxial feeder 22 for AM/FM is connected to the antenna. It is preferable that a central conductor of the coaxing feeder 22 is connected to a feeding point 26 via a capacitor to prevent DC current through the heating line from flowing into the coaxial feeder 22.

This glass antenna system functions in the same manner as the system in FIG. 1.

According to the present invention described above, the following effects are obtained.

(1) A glass antenna system for vehicles for receiving AM and FM bands may be implemented in a simple structure.

(2) A better sensitivity for FM band (76–90 MHz) may be realized, because a slot antenna is formed utilizing the circumference of a window glass to obtain the length of an antenna enough for FM band.

(3) A better sensitivity of a glass antenna system is realized for a window glass having a small area using an electrically conductive transparent film, because the position of a short stub between a silver printed line and a loop-shaped silver printed line is selected so that the impedance of a slot antenna is matched to that of a feeder.

What is claimed is:

1. A glass antenna system for vehicles comprising:

an electrically conductive portion formed on a window glass of a vehicle except for a region adjacent to a metal portion of a vehicle surrounding the window glass;

a loop-shaped electrically conductive printed line formed in the region so that an opening is formed surrounding the electrically conductive portion and so as to be capacitively connected to the metal portion;

an electrically shorted portion to short between the electrically conductive portion and the loop-shaped electrically conductive printed line; and a coaxial feeder, the central conductor thereof being connected to the electrically conductive portion and the outer conductor thereof being connected to the metal portion;

wherein the electrically conductive portion and the loop-shaped electrically conductive printed line function as AM antenna, and the opening functions as FM antenna.

2. An antenna system for vehicles according to claim 1, wherein the electrically shorted portion is provided at a position where the impedance of a slot antenna formed by the opening is matched to that of the coaxial feeder.

3. An antenna system for vehicles according to claim 1, wherein the electrically conductive portion is formed by an electrically conductive transparent film.

4. An antenna system for vehicles according to claim 3, wherein an electrically conductive printed line is formed on the peripheral portion of the electrically conductive transparent film.

5. An antenna system for vehicles according to claim 1, wherein the electrically conductive portion is composed of a ladder-shaped electrically conductive pattern.

6. An antenna system for vehicles according to any one of claims 1–5, wherein the window glass is a side glass.

7. An antenna system for vehicles according to any one of claims 1–5, wherein the window glass is a windshield.

8. An antenna system for vehicles according to claim 1, wherein the electrically conductive portion is composed of a heating line and an electrically conductive printed line formed at the circumference of the heating line.

9. An antenna system for vehicles according to claim 8, wherein the window glass is a rear glass.

* * * * *